US007080925B1

(12) United States Patent
Rushing

(10) Patent No.: US 7,080,925 B1
(45) Date of Patent: Jul. 25, 2006

(54) DIFFUSE LIGHTING ARRANGEMENT

(76) Inventor: John A. Rushing, 1165 Tern Dr., Palatine, IL (US) 60067

( * ) Notice: Subject to any disclaimer, the term of this patent is extended or adjusted under 35 U.S.C. 154(b) by 975 days.

(21) Appl. No.: 09/433,761

(22) Filed: Nov. 4, 1999

(51) Int. Cl.
*F21V 21/00* (2006.01)

(52) U.S. Cl. ..... 362/249; 362/252; 362/391; 362/396; 362/806

(58) Field of Classification Search ..... 362/249, 362/252, 391, 147, 396, 806, 431, 238, 239, 362/251; 224/163, 578, 176, 178, 182, 651; 24/35; 248/691, 692, 693, 100, 694; 249/691, 249/692, 693, 100, 694
See application file for complete search history.

(56) References Cited

U.S. PATENT DOCUMENTS 3,968,398 A * 7/1976 Lehmann ..... 315/185
4,720,773 A * 1/1988 Ahroni ..... 362/249
4,777,573 A * 10/1988 Liao ..... 362/249
4,779,177 A * 10/1988 Ahroni ..... 362/236
5,560,975 A * 10/1996 Casper ..... 428/99
5,957,416 A * 9/1999 Sellati ..... 248/61
5,967,644 A * 10/1999 Pan ..... 362/249
5,975,717 A * 11/1999 Rahman ..... 362/251
6,074,244 A * 6/2000 Crum et al. ..... 439/505
6,109,765 A * 8/2000 Blanton ..... 362/250
6,224,239 B1 * 5/2001 Adler ..... 362/252

* cited by examiner

*Primary Examiner*—Sandra O'Shea
*Assistant Examiner*—Anabel Ton
(74) *Attorney, Agent, or Firm*—Kajane McManus

(57) ABSTRACT

The diffuse lighting arrangement comprises a plurality of strands of miniature lights branching off a power supply cord. An accessory anchor strap is provided for use when it is desired to secure the arrangement to a structure such as a patio umbrella or gazebo.

8 Claims, 2 Drawing Sheets

DIFFUSE LIGHTING ARRANGEMENT

BACKGROUND OF THE INVENTION

1. Field of the Invention

The invention relates to a diffuse lighting arrangement. More particularly, a plurality of strands or strings of miniature lights branch off a power supply cord and may be arranged into a radial array if desired for use on an item such as a patio umbrella or gazebo.

2. Prior Art

Heretofore, U.S. Pat. No. 5,053,931 of John Rushing, the inventor herein, has proposed the provision of a radial array of miniature light strands which feed into a central connection box having means for engaging the strings to a power supply cord.

As will be described in greater detail hereinafter, the diffuse lighting arrangement disclosed herein proposes simplification of the previous embodiment by eliminating the need for the central connection box.

SUMMARY OF THE INVENTION

According to the invention there is provided a diffuse lighting arrangement comprising a main power cord having a plug at one end thereof and incorporating a plurality of identical, minimally spaced apart strings of spaced apart miniature lights extending from the power cord.

Further according to the invention there is provided an accessory anchor strap for use when it is desired to anchor the lighting arrangement.

DESCRIPTION OF THE PREFERRED EMBODIMENT

Figures 1, 2:
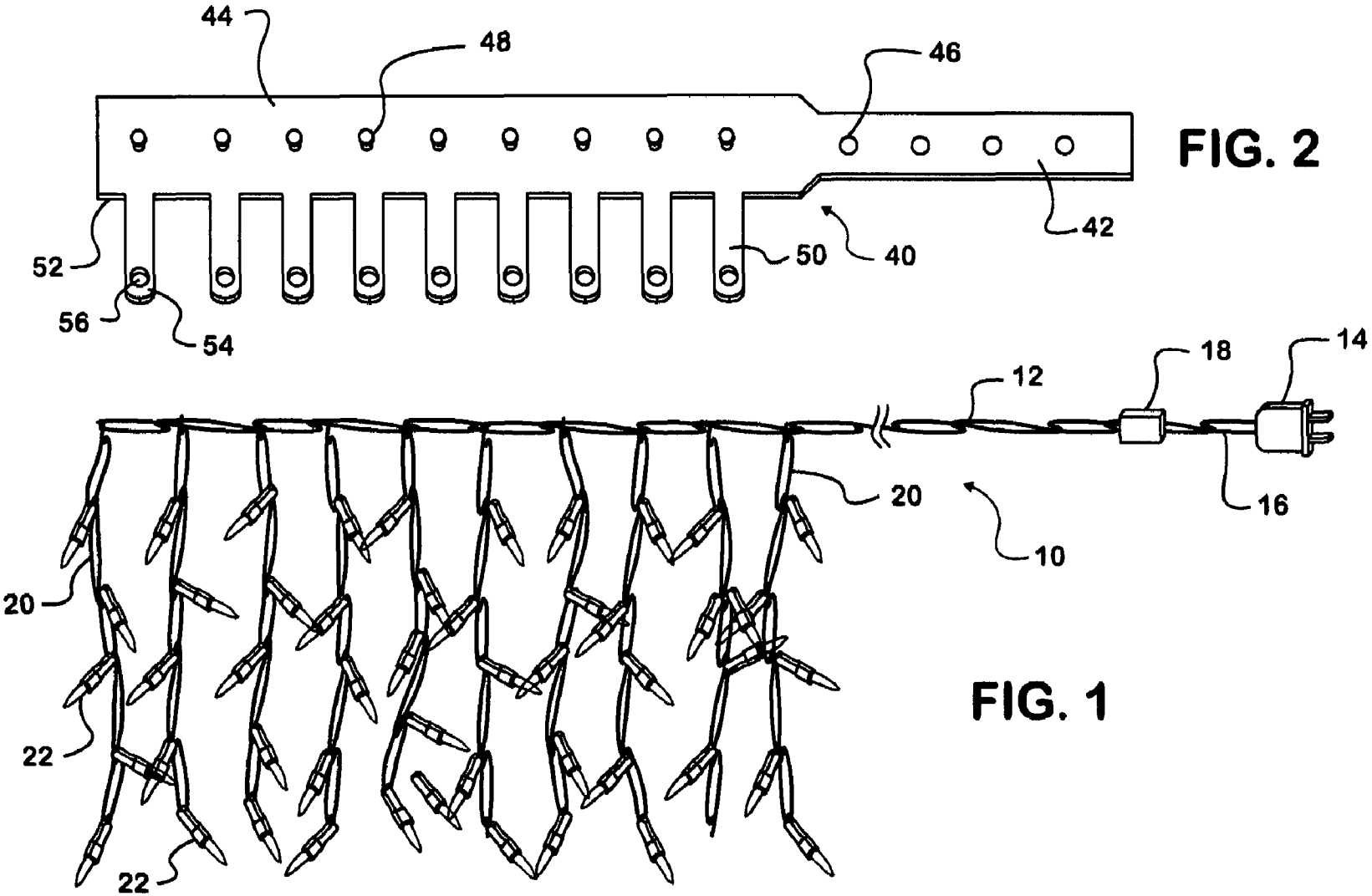
FIG. 1 is a perspective view of the diffuse lighting arrangement of the present invention.
FIG. 2 is a perspective view of an accessory anchor strap for use in anchoring the lighting arrangement to a support structure such as the shaft of a patio umbrella.

Referring now to the drawings in greater detail there is illustrated in FIG. 1 the diffuse lighting arrangement made in accordance with the teachings of the present invention and generally identified by the reference numeral 10.

As illustrated, the arrangement 10 includes a power supply cord 12 which includes a plug 14 at one end 16 thereof for engagement to a power supply (not shown). Preferably, inasmuch as the arrangement 10 is proposed for outdoor use, a circuit protection device 18 is provided on the power supply cord 12 at a position upstream of the plug 14 to prevent the possibility of electrical shock to the user.

Branching off the power supply cord 12 are a plurality of parallel connected strings or wire strands 20 upon each of which a plurality of series connected miniature lights 22 are provided, with the strings 20 in a preferred embodiment, being of approximately equal length.

When the power supply cord 12 is extended horizontally as shown in FIG. 1, the strings 20 of lights 22 depend from the power supply cord 12 in parallel configuration.

Figure 3:
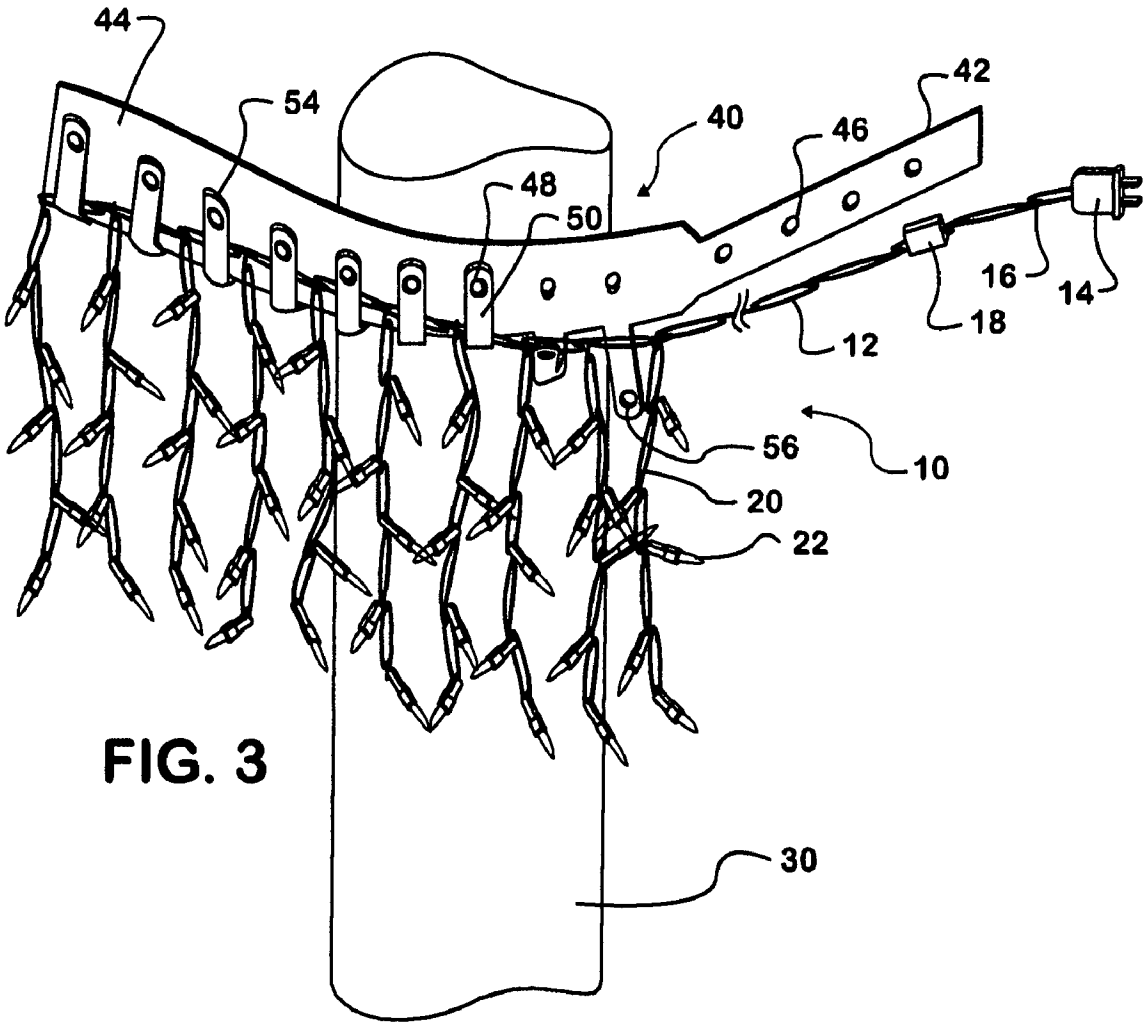
FIG. 3 is a perspective view of the anchor strap shown in combination with the lighting arrangement as proposed for use in anchoring the lighting arrangement to the structure.

It is proposed to provide each of the strings 20 with a fairly substantial length, such that, should it be desired to engage the arrangement 10 to the underside of a patio umbrella (not shown) the strings 20 would extend along a substantial portion of the length of each radial support rib of the umbrella, in a radial array from a center support structure 30 such as the shaft 30 (FIG. 3) of the umbrella.

Alternatively, it will be understood that the arrangement 10 could be engaged to structure such as deck railing (not shown) with each string 20 of lights 22 extending along support columns for such railing, or the interior of a gazebo roof (not shown).

Turning now to FIG. 2, there is illustrated therein an accessory anchor strap 40 for use with the arrangement 10 when it is desired to mount the arrangement 10 to a supporting structure 30.

It will be seen that, in a preferred embodiment, the strap 40 comprises an elongate planar member 40 having cooperating structure on opposite ends 42 and 44 thereof for securing the strap 40 about the shaft 30 of an umbrella.

In the illustrated embodiment, the first end 42 of the strap 40 has a linear array of spaced apart holes 46 therein, while the second end 44 has a plurality of nubs 48 thereon, over which the holes 46 of the first end 42 of the strap 40 engage in snap fit manner.

A plurality of spaced apart restraints 50 are provided along one elongate edge 52 of the strap 40, with one restraint 50 aligning with each of the nubs 48 on the strap 40. At a free end 54 of each restraint 50, there is provided a hole 56 which is engageable over a corresponding nub 48 in snap fit manner when the restraint 50 is folded upwardly over itself to position the hole 56 in the free end 54 thereof over the cooperating nub 48. In this manner, when the restraints 50 are engaged to the nubs 48, they create a series of loops within which the power cord 12, in areas between the spaced apart light strings 20, can be ensnared, as best alluded to in FIG. 3.

The strings 20 of lights 22 can then be elevated and engaged to support ribs of a patio umbrella for example, or could be left to drop along the length of a pole, or twisted around a pole, and fixed in the desired position in any suitable known manner.

As described above, the diffuse lighting arrangement 10 of the present invention provides a number of advantages, some of which have been described above and others of which are inherent in the invention. Also, modifications may be proposed to the structures disclosed without departing from the teachings herein. For example, the anchor strap 40 could take various other forms or could be replaced by any other suitable structure or could merely be fixed to and along a support structure which is not tubular. Accordingly the scope of the invention is only to be limited as necessitated by the accompanying claims.

The invention claimed is:

1. A diffuse lighting arrangement comprising a power supply cord having a plug at one end thereof and incorporating a plurality of identical minimally spaced apart strings of spaced apart miniature lights extending from the power cord, each of the strings of spaced apart miniature lights being electrically connected to the power supply cord in parallel, and further including at least one accessory anchor strap which is adjustable in length wherein said at least one anchor strap engages said diffuse lighting arrangement along the length of said power cord.

2. The arrangement of claim 1 wherein the strings of spaced apart miniature lights are substantially identical in length.

3. The arrangement of claim 1 wherein the miniature lights on each of the strings of spaced apart miniature lights are electrically connected in series.

4. The arrangement of claim 1 wherein the power supply cord includes a circuit protection device.

5. The arrangement of claim 1 wherein the at least one accessory anchor strap has two ends which are engageable to each other about a structure.

6. The arrangement of claim 1 wherein the at least one accessory anchor strap has two elongate edges with a plurality of spaced apart restraints depending from one of the elongate edges.

7. The arrangement of claim 6 wherein a free end of each restraint incorporates structure thereon which engages a corresponding one of an equal plurality of cooperating engagement structures which are spaced apart along the anchor strap.

8. For use on a structure including a radial array of a plurality of support ribs extending from a center support thereof, a diffuse lighting arrangement comprising a power supply cord terminating in a plug and having a plurality of identical, minimally spaced apart strings of miniature lights extending therefrom, equal to the plurality of supporting ribs, and an anchor strap engageable at the center of the structure and incorporating a plurality of anchoring structures which engage the power supply cord to the center support in areas between the spaced apart strings of miniature lights.

* * * * *